US012767476B2

(12) United States Patent
Salonen et al.

(10) Patent No.: US 12,767,476 B2
(45) Date of Patent: Oct. 20, 2026

(54) VACUUM BOX FOR A BELT CONVEYOR AND BELT CONVEYOR FOR CONVEYING VENEER SHEETS

(71) Applicant: Raute Oyj, Nastola (FI)

(72) Inventors: Mikko Salonen, Porlammi (FI); Roope Eskola, Lahti (FI); Jussi Ojalainen, Imatra (FI); Ville Heimonen, Tampere (FI)

(73) Assignee: RAUTE OYJ, Nastola (FI)

( * ) Notice: Subject to any disclaimer, the term of this patent is extended or adjusted under 35 U.S.C. 154(b) by 0 days.

(21) Appl. No.: 18/722,490

(22) PCT Filed: Dec. 14, 2022

(86) PCT No.: PCT/FI2022/050835
§ 371 (c)(1),
(2) Date: Jun. 24, 2024

(87) PCT Pub. No.: WO2024/126888
PCT Pub. Date: Jun. 20, 2024

(65) Prior Publication Data

US 2025/0058992 A1 Feb. 20, 2025

(30) Foreign Application Priority Data

Dec. 23, 2021 (FI) ..... 20216340

(51) Int. Cl.
*B65H 3/12* (2006.01)
*B65H 29/24* (2006.01)

(52) U.S. Cl.
CPC ..... *B65H 29/241* (2013.01); *B65H 3/124* (2013.01); *B65H 2406/3124* (2013.01); *B65H 2406/32* (2013.01); *B65H 2701/1938* (2013.01)

(58) Field of Classification Search
CPC ..... B65H 29/241; B65H 3/124; B65H 2406/3124; B65H 2406/32;
(Continued)

(56) References Cited

U.S. PATENT DOCUMENTS 4,637,599 A 1/1987 Eerola
5,562,281 A * 10/1996 Honda ..... B65H 29/68 271/220
2009/0057102 A1 3/2009 Gibson

FOREIGN PATENT DOCUMENTS

DE 1756949 A1 6/1971
EP 1777176 B1 10/2009
(Continued)

OTHER PUBLICATIONS

Machine translation of JP4-89729. (Year: 1992).*
(Continued)

*Primary Examiner* — Thomas A Morrison
(74) *Attorney, Agent, or Firm* — NIXON & VANDERHYE

(57) ABSTRACT

A vacuum box for a vacuum belt conveyor system for conveying a veneer sheet is provided, the vacuum box comprises a housing having a top plate, wall plates, a bottom plate and end plates, wherein at least one opening is arranged between the bottom plate of the housing and each of the wall plates of the housing along a length of the vacuum box and wherein a shape of the bottom plate is such that edge areas of the bottom plate are further away from an imaginary plane on which the veneer sheet is conveyable than a middle area of the bottom plate. A vacuum belt conveyor system is also provided.

7 Claims, 4 Drawing Sheets

(58) Field of Classification Search
CPC ..... B65H 2701/1938; B65H 3/08; B65H 3/0816; B65H 3/12; B65H 3/128
See application file for complete search history.

(56) References Cited

FOREIGN PATENT DOCUMENTS

| | | | | |
|---|---|---|---|---|
| FI | 58898 | B | | 1/1981 |
| FI | 118044 | B | | 6/2007 |
| FR | 2461668 | A1 | | 2/1981 |
| JP | S5774103 | A | | 5/1982 |
| JP | 4-89729 | | * | 3/1992 |
| JP | H0789623 | B2 | | 9/1995 |
| JP | 2018-131302 | | * | 8/2018 |

OTHER PUBLICATIONS

Machine translation of JP2018-131302. (Year: 2018).*
International Search Report and Written Opinion of the ISA for PCT/FR2022/050835, mailed Jul. 5, 2023, 12 pages.
Finnish Search Report for FI20216340, dated Jun. 29, 2022, 2 pages.

* cited by examiner

VACUUM BOX FOR A BELT CONVEYOR AND BELT CONVEYOR FOR CONVEYING VENEER SHEETS

CROSS-REFERENCE TO RELATED APPLICATIONS

This application is the U.S. national phase of International Application No. PCT/FI2022/050835 filed Dec. 14, 2022, which designated the U.S. and claims priority to FI 20216340 filed Dec. 23, 2021, the entire contents of each of which are hereby incorporated by reference.

TECHNICAL FIELD

The invention concerns in general the technical field of handling of veneer sheets. More particularly, the invention concerns conveying the veneer sheets.

BACKGROUND

One commonly used solution for conveying veneer sheets in a production line is to use a so-called vacuum belt conveyor, which consists of an elongated box structure whose interior can be brought under a vacuum effect. At least one lane-like perforation extends along the bottom of the box through which the bottom area of the box can be brought under the vacuum effect prevailing inside the case. The lane is bounded by a conveyor belt running at its both edges in dragging contact with the lower surface of the vacuum box. The veneer sheet to be conveyed is brought, at its upper surface, under the vacuum effect through the openings, the sheet thus being moved by the belts to the intended place where it is released from the vacuum effect by stamping by means of kicker arms provided in the conveyor. An example of such a vacuum belt conveyor is disclosed in a document US 2009/0057102 A1.

Generally speaking, vacuum belt conveyors have been used to transfer veneer sheets, among other things, even as embodiments in which the veneer sheet lies on a top of the conveyor. A vacuum inside the conveyor affects the lower surface of the veneer sheet holding the sheet pressed against the belts that convey the sheet. Even in these embodiments the belts are placed adjacent to a vacuum area to bound the vacuum area.

The known vacuum belt conveyors are efficient solutions for conveying veneer sheets, but their energy efficiency is not optimal. In other words, the energy consumption, cf. a consumption of electricity, in the known vacuum belt conveyors is big compared to vacuum effect and a capability to lift the sheets, which are needed to keep the veneer sheets reliably in the suction achieved with a partial vacuum i.e. by arranging a pressure being below the ambient pressure. The main reason for the nonoptimal energy consumption is that the known solutions are developed without paying enough attention to aspects relating to air flow, and physics therein, and due to this a big volume flow is needed to generate a partial vacuum being big enough and causing a lift force needed for conveying the veneer sheets. That means that for generating the necessary volume flow in the vacuum belt conveyors blowers having a big capacity are needed, which means additional costs in terms of the price of the blowers but also in terms of electricity needed.

In view of above there is a need to introduce solutions, such as vacuum boxes and belt conveyers comprising such vacuum boxes, which alleviate the above described problems, and, hence, improve at least in part an energy consumption of such systems.

SUMMARY

The following presents a simplified summary in order to provide basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to a more detailed description of exemplifying embodiments of the invention.

An object of the invention is to present a vacuum box and a vacuum belt conveyor system for conveying veneer sheet.

The objects of the invention are reached by a vacuum box and a vacuum belt conveyor system for conveying veneer sheet as defined by the respective independent claims.

According to a first aspect, a vacuum box for a vacuum belt conveyor system for conveying a veneer sheet is provided, the vacuum box comprises a housing having a top plate, wall plates, a bottom plate and end plates, wherein at least one opening is arranged between the bottom plate of the housing and each of the wall plates of the housing along a length of the vacuum box and wherein a shape of the bottom plate is such that edge areas of the bottom plate are further away from an imaginary plane on which the veneer sheet is conveyable than a middle area of the bottom plate.

The at least one opening arranged between the bottom plate of the housing and each of the wall plates of the housing may have a width between 6-12 mm.

The wall plate may comprise a shoulder piece extending towards an outer edge of the bottom plate. For example, a length of the shoulder piece towards the outer edge of the bottom plate may be at least 10 mm.

The vacuum box may comprise a front opening extending over a width of the bottom plate.

Still further, a height of the bottom plate may be between 4.5-28 mm.

The bottom plate may have a shape of at least one of the following: at least in part V-shaped; at least in part curved; the middle area is arranged to travel parallel to the imaginary plane on which the veneer sheet is conveyable. For example, the bottom plate may comprise at least a middle area having the V-shape, a bending angle of the V-shaped middle area may be between 150-175 degrees.

According to a second aspect, a vacuum belt conveyor system for conveying a veneer sheet is provided, the vacuum belt conveyor system comprises:

- a vacuum box according to the first aspect as defined above,
- a number of suction devices configured to suck air from the vacuum box through at least one conduit to cause a vacuum effect through at least one opening arranged between a bottom plate of a housing of the vacuum box and each of wall plates of the housing of the vacuum box,
- a plurality of belt conveyor devices associated to the vacuum box on both sides of the vacuum box to convey the veneer sheet suspended against belts of the plurality of belt conveyor devices with the vacuum effect.

The bottom plate may be positioned with respect to an imaginary plane defined by those belt sections of the plurality of belt conveyor devices against which the veneer sheet is suspendable so that a middle area of the bottom plate travels above the imaginary plane. For example, the distance between the middle area of the bottom plate and the imaginary plane may be between 5 to 12 mm.

Further, the vacuum belt conveyor system may further comprise a number of kicker arms for providing a force to the veneer sheet suspended with the vacuum effect to release it from the suspension.

The number of suction devices may be at least one of the following types: a blower, a vacuum pump.

The expression "a number of" refers herein to any positive integer starting from one, e.g. to one, two, or three.

The expression "a plurality of" refers herein to any positive integer starting from two, e.g. to two, three, or four.

Various exemplifying and non-limiting embodiments of the invention both as to constructions and to methods of operation, together with additional objects and advantages thereof, will be best understood from the following description of specific exemplifying and non-limiting embodiments when read in connection with the accompanying drawings.

The verbs "to comprise" and "to include" are used in this document as open limitations that neither exclude nor require the existence of unrecited features. The features recited in dependent claims are mutually freely combinable unless otherwise explicitly stated. Furthermore, it is to be understood that the use of "a" or "an", i.e. a singular form, throughout this document does not exclude a plurality.

BRIEF DESCRIPTION OF FIGURES

The embodiments of the invention are illustrated by way of example, and not by way of limitation, in the figures of the accompanying drawings.

DESCRIPTION OF THE EXEMPLIFYING EMBODIMENTS

The specific examples provided in the description given below should not be construed as limiting the scope and/or the applicability of the appended claims. Lists and groups of examples provided in the description given below are not exhaustive unless otherwise explicitly stated.

Figure 1:
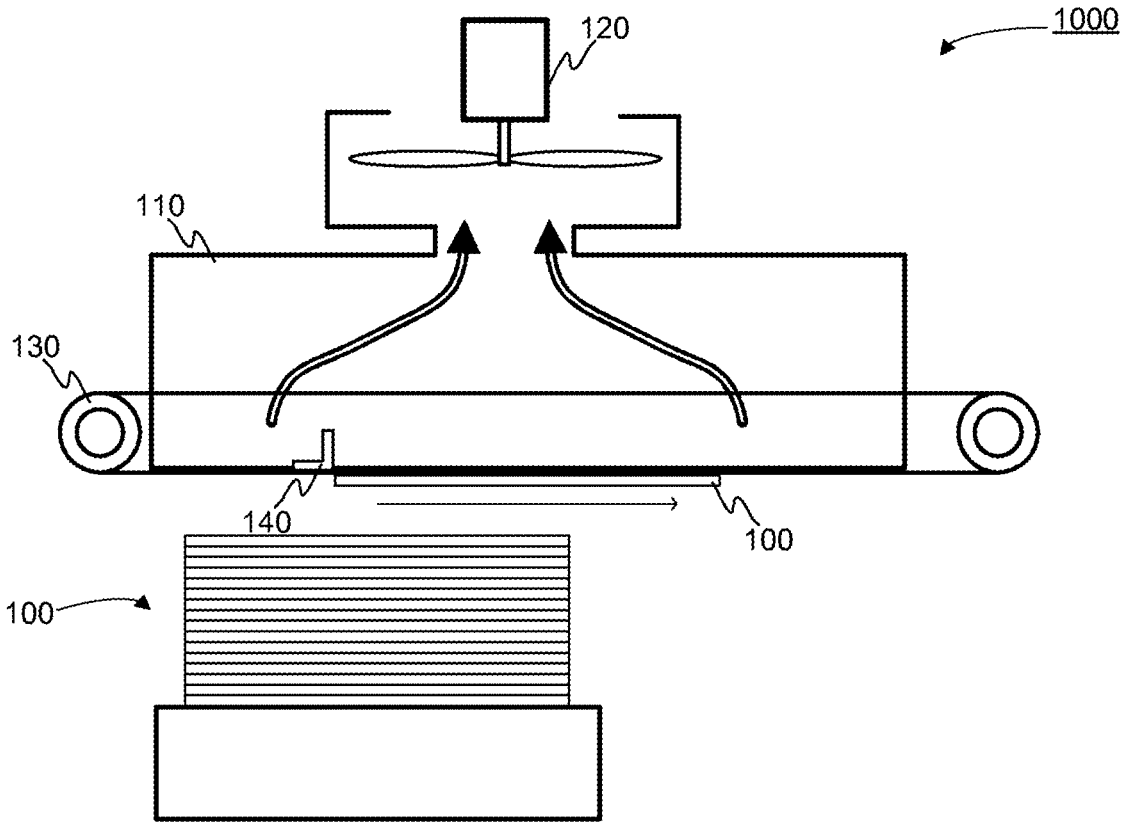
FIG. 1 illustrates schematically a vacuum belt conveyor according to an example.

FIG. 1 illustrates schematically a vacuum belt conveyor system 1000, or an apparatus, according to an example of the present invention from a sideways perspective. The system 1000 is illustrated in a simplified manner disclosing only some features of the system to provide basic understanding of the system 1000 in which the veneer sheets 100 are conveyed to and/or from a stack of veneer sheets 100 with the vacuum belt conveyor system 1000. The vacuum belt conveyor system 1000 comprises a vacuum box 110, also known as a suction box, which defines a volume into which a partial vacuum i.e. a pressure being below an ambient pressure in the external space to the vacuum box 110 is generated with a number of suction devices 120 which are configured to convey, or suck, air out from the vacuum box 110 as indicated with arrows in FIG. 1. The vacuum box 110 has a structure improving an air flow in the vacuum belt conveyor system 1000 and, thus, at least in part reduces an energy consumption of the vacuum belt conveyor system 1000. The partial vacuum generated inside the vacuum box 110 enables the conveyance of the veneer sheet 100 below the vacuum box 110 since the bottom of the vacuum box 110 is provided with openings though which a suction towards the veneer sheet 100 may be provided, and, thus, the gripping of the veneer sheet 100 is achieved.

Furthermore, the vacuum belt conveyor system 1000 comprises a number of belt conveyor devices 130 in which a conveyor belt is arranged to move in a loop between traveling wheels. Into at least one of the wheels a rotational force is brought e.g. with an electrical motor so as to achieve the loop rotation of the conveyor belt. Typically, the vacuum belt conveyor system 1000 is provided with two belt conveyor devices 130 being in a predefined distance from each other. The lower portion of the conveyor belts is vertically adjusted to run so that a contact surface to the veneer sheet 100 is at the same level as the bottom of the vacuum box 110, or little below that, and in any case so that a suction effect to the veneer sheet 100 is enough to keep it in contact with the contact surface of the conveyor belt. In the described implementation the veneer sheets 100 may be kept suspended against the conveyor belts and conveyed to a desired place. Furthermore, the vacuum belt conveyor system 1000 may comprise a number of so-called kicker arms 140 e.g. on both sides of the vacuum box 110 by means of which the carried veneer sheet 100, by kicking it off with a kicking force, can be released from the suspension caused by the generated vacuum effect through the openings.

Figure 2:
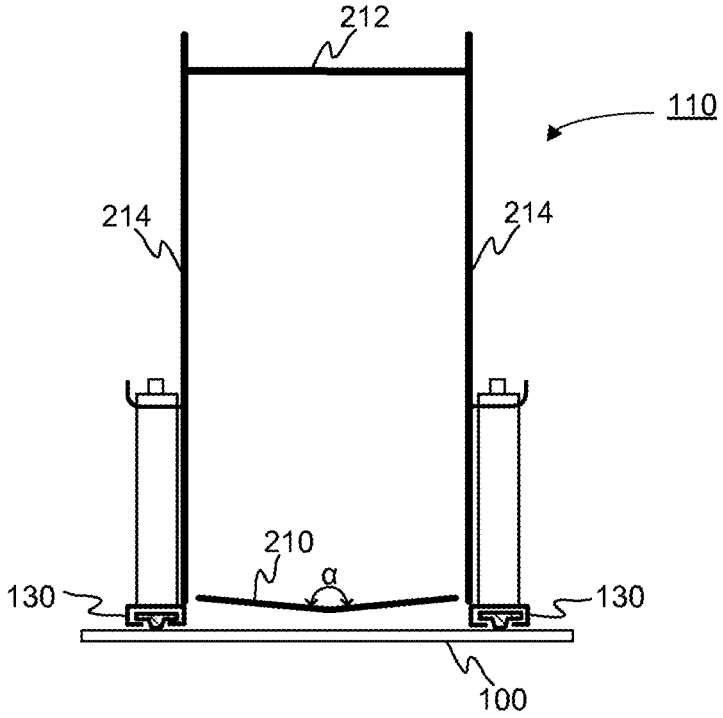
FIG. 2 illustrates schematically a vacuum box according to an example from a first perspective.

FIG. 2 illustrates schematically an example of the vacuum box 110 according to the invention. The vacuum box 110 of FIG. 2 is illustrated as a cross-sectional view with respect to a conveyance direction of the veneer sheet 100. The example of FIG. 2 also illustrates the two belt conveyor devices 130 on both sides of the vacuum box 110 towards which, i.e. the belts of the respective belt conveyor devices 130, the veneer sheet 100 under transport is engaged with the partial vacuum arranged inside the vacuum box 110. The vacuum box 110 has an elongated structure forming a housing for the vacuum box 110. The housing comprises at least a top plate 212, wall plates 214 and a bottom plate 210 as well as end plates (not shown in FIG. 2 closing the structure at the ends. The mentioned items of the structure may be formed e.g. from a metal sheet by bending at least the top plate 212 and the wall plates 214 in the illustrated shape. The bottom plate 210 may be formed separately into its shape and associated, or fixed, to the vacuum box structure 110 with any known fixing solutions, such as by applying applicable support structures and fixing devices, such as screws. Alternatively, the bottom plate 210 shaped as described in the forthcoming description may be fixed to the other structure e.g. by welding it with the other items. In a further embodiment also the bottom plate 210 may be shaped from the same metal sheet as at least one other plates. The end plates may also be fixed in a similar manner. For sake of clarity it is worthwhile to mention that also the top plate 212 and the wall plates 214 may be separate items and fixed together e.g. by welding to form the elongated structure of the vacuum box 110. Hence, the terminology using the term "plate" shall not be interpreted only to cover an implementation in which the plates are separate pieces fixed together but they, or at least part of them, may be formed from physically one piece e.g. of a metal sheet.

In order to enhance the vacuum effect towards the veneer sheet 100 the vacuum box 110 is configured so that a bottom plate 210 of the vacuum box 110 is shaped in a predefined form. The form, or the shape, of the bottom plate 210 is advantageously such that it aims to reduce a volume between the bottom plate 210 and an imaginary plane on which the veneer sheet 100 is conveyed. Such a shape of the bottom plate 210 is advantageously such that its edges, or edge areas, in the conveyance direction of the veneer sheet 100 are further from the imaginary plane on which the veneer sheet 100 is conveyed than a middle area of the bottom plate 210. In other words, the middle area extends more outwards than the edges when seen from inside the vacuum box 110.

In accordance with an embodiment of the present invention the shape of the bottom plate 210 is bent in a V-shaped form in the non-limiting example of FIG. 2 and positioned so that an edge of the V shape, or the bending edge, travels along a length of the vacuum box 110 i.e. in a direction the veneer sheet 100 is conveyable with the vacuum box 110 together with other entities. As derivable e.g. from FIG. 2, an apex, or a tip, of the V-shaped bottom plate 210, i.e. the edge of the bent bottom plate 210, extends outwards from the vacuum box 110 and the V-shape is symmetric and the sides of the bent bottom plate 210 have substantially the same length. A bending angle $\alpha$ of the bottom plate 210 forming the V-shape may preferable be close to a straight angle, e.g. between 150-175 degrees, advantageously around 172 degrees. Additionally, the bottom plate 210 may be positioned with respect to an imaginary plane on which the veneer sheet 100 is conveyed so that the edge of the V-shaped bottom plate 210 travels a predefined distance above the imaginary plane wherein the distance may e.g. be between 5-12 mm, advantageously around 8.5 mm. The conveying plane of the veneer sheets 100 is defined by belt sections of the belts of the belt conveyor devices 130 towards which the veneer sheet 100 is suspendable with the suction achieved with the partial vacuum. The above mentioned values are especially applicable with a vacuum box 110 having a width of 226 mm and a height of 506 mm. In case the V-shaped bottom plate 210 is used the vacuum effect is in its maximum around the apex area of the V-shaped bottom plate 210. This may cause some bending of the veneer sheet 100, especially with thin sheets, and the apex of the bottom plate 210 may provide support to the veneer sheet 100 during the conveyance.

Figure 3A:
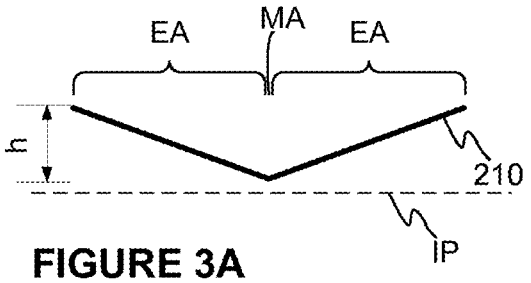
FIGS. 3A-3I illustrate schematically various shapes of a bottom plate according to examples.
Figure 3B:
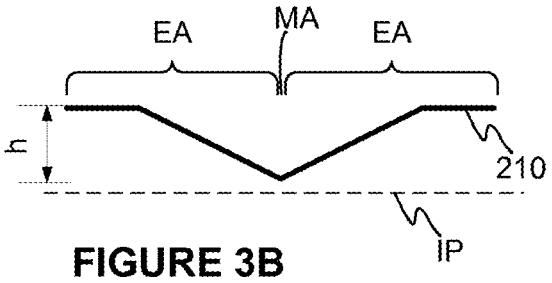
Figure 3C:
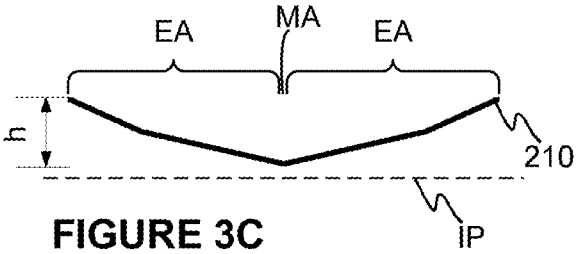
Figure 3D:
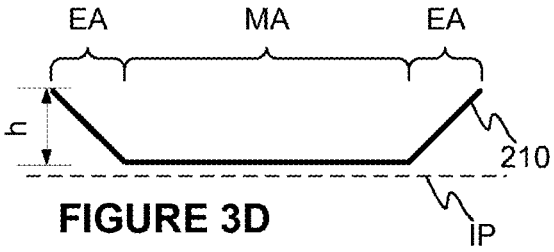
Figure 3E:
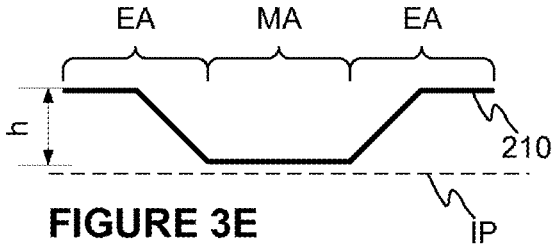
Figure 3F:
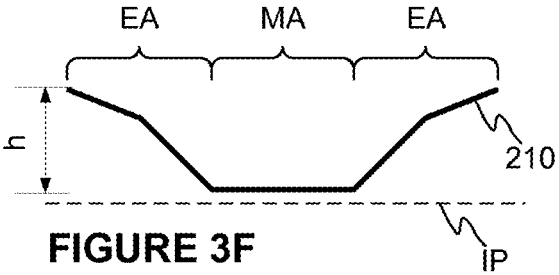
Figure 3G:
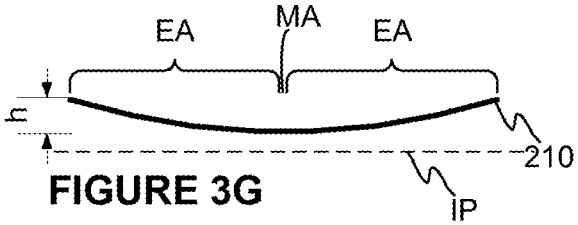
Figure 3H:
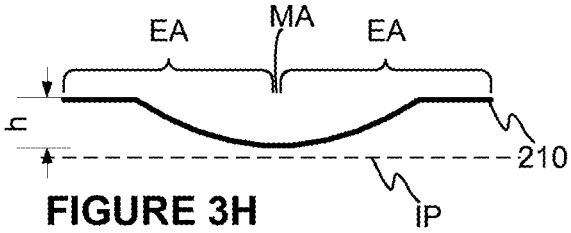
Figure 3I:
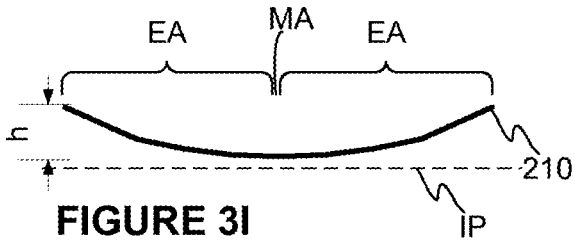

FIGS. 3A, 3B, 3C, 3D, 3E, 3F, 3G, 3H, 3I illustrate schematically some non-limiting examples of the shapes of the bottom plates 210 in accordance with the invention. In FIGS. 3A-3I an imaginary plane on which the veneer sheet 100 is conveyable is marked with a dashed line and denoted with an abbreviation IP in order to improve an interpretation of the respective figures. Moreover, in FIGS. 3A-3I the edge areas of the bottom plate is denoted with EA whereas the middle area is denoted with MA. The shape of the bottom plate 210 in FIGS. 3A-3C is based on the V-shape as already mentioned in the context of FIG. 2. The middle area MA in these embodiments may be considered as a point in the bottom plate 210 extending most outwards from inside the vacuum box 110, or the point being closest to the imaginary plane IP. The edge areas EA are more distant from the imaginary plane IP than the middle area MA and in the implementation of FIGS. 3A-3C the edge areas are formed in a continuous manner as in FIG. 3A or consisting of two or more sections having different angles and connected together as shown in FIGS. 3B and 3C. As seen from FIG. 3B one section may be arranged substantially parallel to the imaginary plane IP. The embodiments of FIGS. 3D-3F are based on implementations in which the middle area of the bottom plate 210 travels parallel to the imaginary plane IP whereas the edge areas EA consists of one or more sections arranged in various angle(s) with respect to the imaginary plane IP. Still further, FIGS. 3G-3I schematically illustrate embodiments in which at least part of the bottom plate 210 is shaped as curved, or arched, and the middle area MA is a point of the curved section being closest to the imaginary plane IP. It may be arranged that a part of the edge area EA is shaped as straight whereas another part of the edge area EA is curved as shown in FIGS. 3H and 31. In FIG. 3G the whole bottom plate is curved. For sake of clarity, it is worthwhile to mention that the bottom plates 210 as shown at least in FIGS. 3A-3I are sectional drawings of the mentioned entities and the shape of them is described accordingly. As derivable from the description herein the bottom plate 210 has a length in the conveyance direction of the veneer sheet 100 (cf. e.g. FIG. 1) and the above discussed shapes do not relate to the shape of the bottom plate 210 in that direction. Furthermore, the bottom plates 210 as shown in FIGS. 3A-3I are non-limiting examples and various other shapes may be provided under the present invention. As said, the shape of the bottom plate 210 in the context of the present invention is such that its edges, i.e. edge areas EA, in the conveyance direction of the veneer sheet 100 are further, i.e. more distant, from the imaginary plane IP on which the veneer sheet 100 is conveyed than a middle area MA of the bottom plate 210. In preferred embodiments a height of the bottom plate 210, i.e. a distance between a plane traveling through the edges, i.e. through the outmost edges, of the bottom plate 210 and a plane traveling through the middle area MA at a point being furthest from the plane traveling through the edges of the bottom plate 210, may be between 4.5 mm-28 mm wherein the referred planes are parallel to each other. For sake of clarity the height of the bottom plate 210 is denoted with a reference h in FIGS. 3A-3I. Such a height may e.g. be arranged to the V-shaped bottom plate 210 with the angle between 150-175 degrees, and wherein the angle of 172 degrees would correspond to a height of 7.5 mm. Still further, as already mentioned in the description of FIG. 2 the apex of the V-shaped bottom plate 210 travels at a predefined distance above the imaginary plane (IP) wherein the distance may e.g. be between 5-12 mm, advantageously around 8.5 mm. The same distance may be applied to with respect to the bottom plates 210 shaped in any other manner, e.g. as shown in FIGS. 3A-3I as non-limiting examples.

Figure 4:
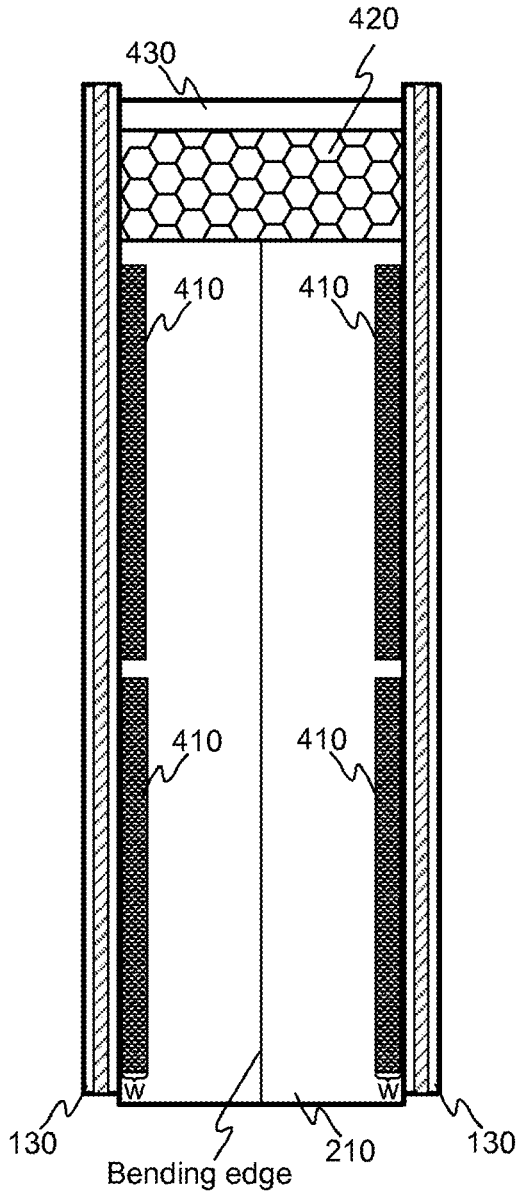
FIG. 4 illustrates schematically the vacuum box according to an example from another perspective.

FIG. 4 illustrates schematically the vacuum box 110 and the belt conveyor devices 130 as seen below the vacuum box 110. The dimensions of the vacuum box 110 of FIG. 4 do not necessarily correspond to the real-world implementation and the aim of FIG. 4 is especially to disclose how openings 410 may be arranged to a bottom plate 210 of the vacuum box 110 along the belt convey devices 130. The shape of the bottom plate 210 in FIG. 4 is V. The openings 410 provide the path to arrange the suction inwards the vacuum box 110 so that the veneer sheet 100 under transport remains suspended against the conveyor belts of the belt conveyor devices 130. The size of the openings 410 may be selected so that the combined area is such that the generated suction is optimal in its characteristics, such as it is as steady as possible and also effective, but also so that the size of the openings 410 prevent at least in part that dirt ends up inside the vacuum box 110 wherein a non-limiting example of the dirt is pieces of veneer moving along the production line. The width (marked with 'w' in FIG. 4) of openings 410 may e.g. be between 6-12 mm, such as 8 mm. The length of the openings 410 may be adjusted in accordance with the length of the vacuum box 210. The bottom plate 210 of FIG. 4 may be fixed with the wall plates 214 e.g. by welding the bottom plate 210 from bridge-like sections between the openings 410 with the respective wall plates 214. As derivable from the description herein the number of openings 410 arranged between the bottom plate 210 and the wall plates 214 of the vacuum box 110 may be implemented by manipulating the shape of the bottom plate 210 in a desired manner. Alternatively or in addition the bottom plate 210 may be dimensioned in a manner that the openings 410 are formed between the mentioned entities. This corresponds e.g. to that a width of the bottom plate 210 is selected so that it does not extend up to the wall plates 214 but is fixed in a desired position with applicable support structure. Moreover, the bending edge of the bottom plate 210 is also marked in FIG. 4 for increasing the informative purpose of FIG. 4.

The openings 410 of FIG. 4 are longitudinal slots but the openings 410 may be arranged in other ways. For example, the openings 410 may be formed from a plurality of smaller openings 410, such as with shorter slots or by arranging that the openings 410 are a continuous line of holes having a circle shape. It is important to guarantee that the openings 410 are implemented so that there are no long sections not having any suction due to lack of openings in the area and that the combined area of the openings 410 enable a suction force being enough for the purpose. In sophisticated solutions the bottom plate 210 is mounted to the other parts of the vacuum box 110 in a manner that the fixing means, such as the bridge structures, has minimal impact to the air flow.

FIG. 4 also illustrates schematically a front opening 420 which is an area in the vacuum box 110 according to an example embodiment through which a suction may be provided in an enhanced manner so that the veneer sheet 100 may be captured e.g. from a stack or from another conveyor device. A width of the front opening 420 of the vacuum box 110 may be defined between the belt conveyor device 130, i.e. extending over the width of the bottom plate 210, and the front opening is covered with an applicable mesh so as to prevent that an excessive amount of dirt ends up inside the vacuum box 110 due to suction. Furthermore, the vacuum box 110 may comprise a support structure 430 to provide support to the veneer sheet 100 sucked with the partial vacuum of the front opening 420. With respect to the front opening 420 and the support structure 430 it is worthwhile to mention that the belts of the belt conveyor devices 130 are adjusted so that they provide the primary support to the veneer sheet 100 in question so as to allow the transport of the veneer sheet 100 from the capturing position along the length of the vacuum belt conveyor system 1000. Depending on an implementation the suction of the front opening 420 may be arranged separately from the other suction of the other openings 410 e.g. by arranging a number of dedicated suction devices 120 to serve the front opening 420.

In some example embodiments the front opening 420 may be arranged to the bottom plate 210. This kind of approach may be suitable for vacuum boxes 110 in which the bottom plate 210 extends substantially over the whole length of the suction box 110. The front opening 420 may be machined to the bottom plate 210 e.g. by cutting the front opening 420 to the end of the bottom plate 210 receiving the veneer sheets 100. The size of the front opening 420 may be adjusted in accordance with the need and its width is advantageously less that the width of the bottom plate 210. Hence, the support structure 430 may be part of the bottom plate 210 as well. Also in these embodiments the front opening 420 may be covered with the applicable mesh and it is possible to arrange that the suction for the front opening 420 of the bottom plate 210 may be arranged separately from the other suction in order to generate the enhanced suction for capturing the veneer sheet 100.

The vacuum box 110 in accordance with the present invention helps reducing pressure drop in other areas than in the openings 410 which improves the suspension of the veneer sheets 100. This is achieved at least part by arranging the bottom plate to be shaped as described which allows optimizing a cross-sectional area of the vacuum box 110 so as to achieve a steady suction.

Figure 5:
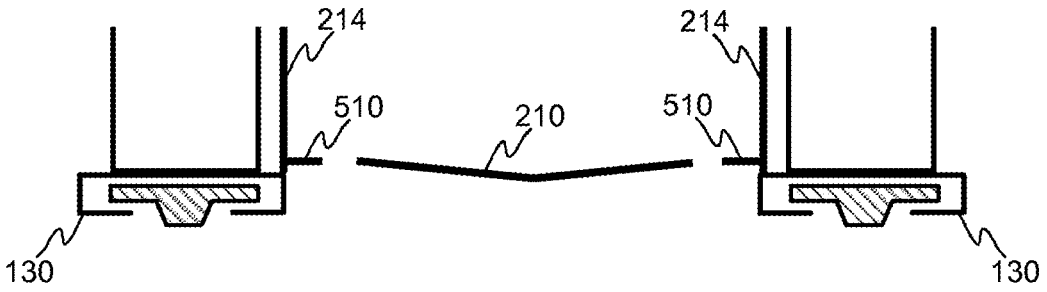
FIG. 5 illustrates schematically further aspect of the vacuum box according to an example.

FIG. 5 illustrates a further aspect in relation to a shape of the vacuum box 110 in accordance with at least some embodiments of the invention when enhances the flow through the opening 410 by a restriction of the air through the opening 410. As derivable from FIG. 5 a shoulder piece 510, or a tread, is arranged on the wall of the vacuum box 110 so that it extends towards a respective outer edge of the bottom plate 210 of the vacuum box 110 as shown in FIG. 5. For example, a length of such shoulder piece 510 may be 10 mm or more towards the outer edge of the bottom plate 210 and this kind of extension causes the restriction of air in an efficient way in the openings 410 of the vacuum box 110. Worthwhile to mention is that at least one aim of the present invention is that the openings 410 are preferably implemented so that the openings 410 are sharp-edged which causes that the pressure drop occurs in the openings 410 in an efficient manner. This may be improved with the shoulder pieces 510 as shown in FIG. 5.

Figure 6:
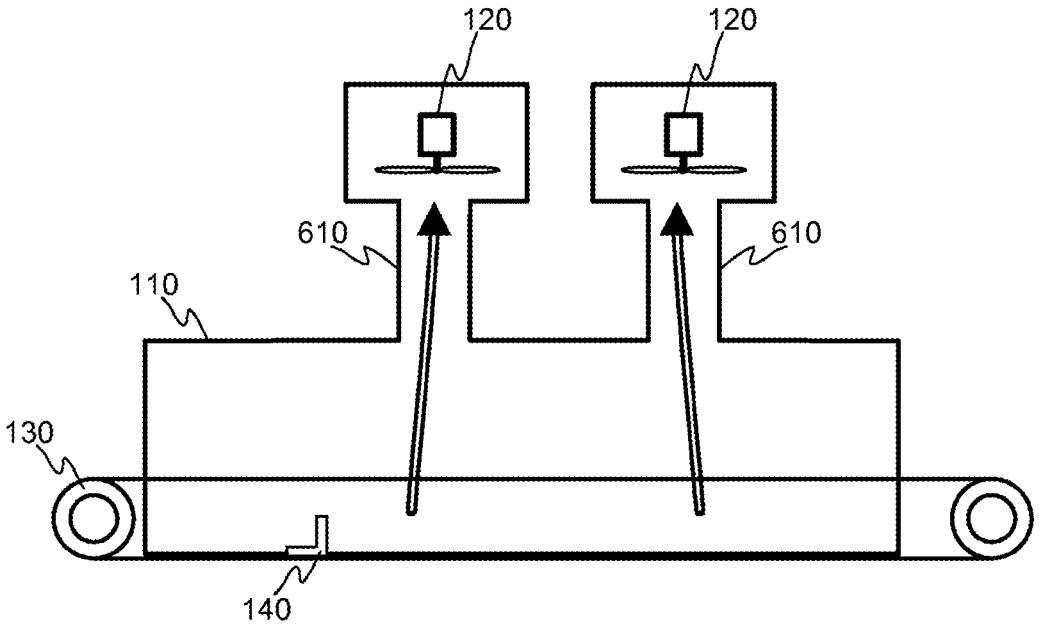
FIG. 6 illustrates schematically a vacuum belt conveyor according to another example.

As already mentioned, the vacuum belt conveyor system 1000 comprises a number of suction devices 120 arranged to suck air out from the vacuum box 110. A non-limiting example of such an implementation is schematically illustrated in FIG. 6. The aim is especially to disclose that the vacuum box 110 is accessed with a number of conduits 610 in order to convey the air from the vacuum box 110 due to a suction caused by the number of suction devices 120. The size of the conduits 610, i.e. especially the diameter of each conduit 610, is adjusted with respect to the size of the openings 410. For example, a rule of thumb may be applied so that a combined cross-sectional area of the conduits 610 is double compared to combined area of the openings 410. This makes the air to flow in the conduits 610 with a half speed compared to the flow in the openings 410. For a sake of clarity, the housing of the suction devices 120 is arranged so that the air brought in the housing may be released out from the housing in a desired manner. Also, depending on the size of the air flow channel as a whole the size of the suction devices 120 may be selected so that the provide necessary power to generate the partial vacuum through the suction of the air as needed.

Figure 7:
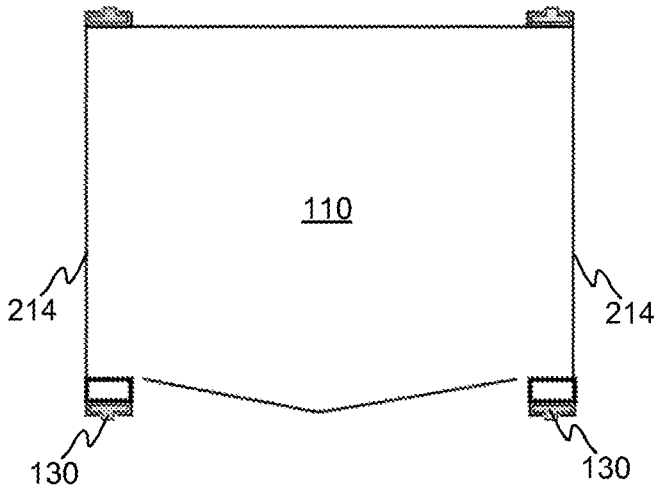
FIG. 7 illustrates schematically a further aspect of the vacuum box according to a further example.

In the various embodiments of the invention as discussed so far it is mainly referred to an implementation in which the belt conveyor devices 130 are associated on an outer surfaces of the vacuum box 110 as e.g. shown in FIG. 2 and FIG. 5. The present invention is not however limited to such an implementation, but other approaches may be taken. FIG. 7 schematically illustrates an example in which the belt conveyor devices 130 are arranged on a bottom side of the vacuum box 110. The belt conveyor device 130 may be fixed therein with separate fixing devices or in some implementations ends of the wall plates 214 are bent inwards and the belt conveyor devices 130 are fixed to the bent portion of the wall plates 214. By adjusting the entities appropriately it may be considered that the belt conveyor devices 130 form the respective shoulder pieces 510 for achieving at least some of the effect as achieved with the implementation as shown in FIG. 5.

In accordance with the present invention a vacuum belt conveyor system 1000 is provided, the vacuum belt conveyor comprising the vacuum box 110 as described herein with other entities. The other entities may comprise the number of belt conveyor devices 130 positioned e.g. on both sides of the vacuum box 110 in the manner as described. Furthermore, the vacuum belt conveyor system 1000 comprises a number of conduits 610 connecting the vacuum box 110 and the respective suction devices 120 so as to form a channel for air flow from the openings of the vacuum box 10 to the housing(s) of the suction device(s) 120, and finally out from the system. Naturally, the vacuum belt conveyor system 1000 may comprise further entities in order to make the system fully operative.

As non-limiting examples of applicable suction devices 120 in the context of the present invention may be mentioned one or more blowers or one or more vacuum pumps wherein the blowers are preferred ones. Other types of suction devices 120 may also be applied to. Moreover, the number of suction devices 120 may be selected in accordance with a desired suction force, but in practice in the context of conveying veneer sheets 100 it has turned out to be optimal to arrange the suction devices 120 every 2-4 meters over the length of the vacuum box 110.

From the operational perspective the vacuum belt conveyor system 1000 may be arranged to operate so that a veneer sheet 100 under transport is picked up with a suction provided from a front opening 420 and a transport of the veneer sheet 100 along the vacuum box 110 is initiated by rotating the conveyor belts of the belt conveyor devices 130 against which the veneer sheet 100 in question is suspended with the suction. The openings 410 of the vacuum box 110 as described along the length of the vacuum box 110 enable keeping the suspension during the transport and when the veneer sheet enters a position of release the kicker arms 140 are instructed with a control signal to perform a kick movement to release the veneer sheet from the suspension, and as a result the veneer sheet 100 drops down. The overall operation may be controlled with a control device of the system 1000 which is programmed to generate control signals to perform the transport operation.

The present invention provides many advantages over the prior art solutions. First, due to that the vacuum effect is improved with the solution according to the present invention which allows to optimize the blowers, or any corresponding devices, which reduce costs of the overall system. Additionally, since the overall air flow is reduced, smaller air filtering stations may be applied to for cleaning the air in the production plants. All in all, the reduced energy consumption in the conveying operation and other operations related to that makes the whole system more environmentally friendly than the prior art solutions.

The V-shaped bottom plate 210 has turned out to produce the advantages in an especially efficient manner over the other shapes based on measurements and tests. This relates to achieved partial vacuum effect towards the veneer sheet 100 under conveyance. A further advantage of the V-shaped bottom plate 210 is that the sharp contact point for veneer sheets 100, i.e. the apex of the V-shaped bottom plate 210, allows to keep the veneer sheet 100 away from the bottom plate 210 as much as possible which means that the suction correspondingly affects the veneer sheet 100 in question on a larger area than with the other shapes of the bottom plate 210. The advantage of the V-shaped bottom plate 210, especially with a wide angle, such as 172 degrees, is that it is the most universal with vacuum belt conveyors arranged to convey veneer sheets 100 having different characteristics, such as the stiffness.

The specific examples provided in the description given above should not be construed as limiting the applicability and/or the interpretation of the appended claims. Lists and groups of examples provided in the description given above are not exhaustive unless otherwise explicitly stated.

What is claimed is:

1. A vacuum box configured to operate with a vacuum belt conveyor system for conveying a veneer sheet, the vacuum box comprising a housing, the housing comprising:

a bottom plate having side edges, a front edge, and a rear edge, the side edges being positioned with respect to the vacuum belt conveyor system so that the side edges are parallel to a direction of travel of the veneer sheet under a condition that the veneer sheet is being transported by the vacuum belt conveyor system, the bottom plate having a middle area between and parallel to the side edges;

wall plates having lower edges that are parallel to the side edges of the bottom plate;

a top plate connected to the wall plates; and end plates arranged respectively at the front and rear edges of the bottom plate, wherein at least one opening is arranged between each of the side edges of the bottom plate and a corresponding one of the lower edges of the wall plates, and wherein a shape of the bottom plate is such that a distance separating the side edges of the bottom plate from an imaginary plane on which the veneer sheet is conveyable is greater than a distance separating the middle area of the bottom plate from the imaginary plane.

2. The vacuum box of claim 1, wherein each of the wall plates comprises a shoulder piece extending towards a respective one of the side edges of the bottom plate.

3. The vacuum box of claim 1, wherein the bottom plate is a solid sheet having a cross-section that is V-shaped when viewed from the front edge or the rear edge of the bottom plate, a valley of the V-shape being arranged in the middle area of the bottom plate.

4. The vacuum box of claim 1, wherein the bottom plate is a solid sheet having a cross-section at least in part curved when viewed from the front edge or the rear edge of the bottom plate, the curved part having a convex face facing the imaginary plane; a lowest portion of the curved part being arranged in the middle area of the bottom plate.

5. A vacuum belt conveyor system configured for conveying a veneer sheet, the vacuum belt conveyor system comprising:

the vacuum box of claim 1;

at least one suction device configured to suck air from the vacuum box through at least one conduit to cause a vacuum effect through the at least one opening of the vacuum box; and a plurality of belt conveyor devices arranged on respective sides of the vacuum box to convey the veneer sheet suspended against belts of the plurality of belt conveyor devices with the vacuum effect.

6. A vacuum belt conveyor system configured for conveying a veneer sheet, the vacuum belt conveyor system comprising:

the vacuum box of claim 2;

at least one suction device configured to suck air from the vacuum box through at least one conduit to cause a vacuum effect through the at least one opening of the vacuum box; and a plurality of belt conveyor devices arranged on respective sides of the vacuum box to convey the veneer sheet suspended against belts of the plurality of belt conveyor devices with the vacuum effect.

7. A vacuum belt conveyor system configured for conveying a veneer sheet, the vacuum belt conveyor system comprising:

the vacuum box of claim 3;

at least one suction device configured to suck air from the vacuum box through at least one conduit to cause a vacuum effect through the at least one opening of the vacuum box; and a plurality of belt conveyor devices arranged on respective sides of the vacuum box to convey the veneer sheet suspended against belts of the plurality of belt conveyor devices with the vacuum effect.

* * * * *